United States Patent [19]

Noeske

[11] 4,409,447

[45] Oct. 11, 1983

[54] GAS BLAST CIRCUIT BREAKER COMBINING A MAGNETICALLY DRIVEN ROTATING ARC AND A PUFFER INDUCED GAS BLAST

[75] Inventor: Heinz O. Noeske, Cherry Hill, N.J.

[73] Assignee: General Electric Company, Schenectady, N.Y.

[21] Appl. No.: 338,747

[22] Filed: Jan. 11, 1982

Related U.S. Application Data

[63] Continuation of Ser. No. 51,115, Jun. 22, 1979, abandoned.

[51] Int. Cl.[3] ..... H01H 33/88; H01H 33/18

[52] U.S. Cl. ..... 200/148 A; 200/147 R

[58] Field of Search ..... 200/148 A, 148 B, 147 R, 200/147 A

[56] References Cited

U.S. PATENT DOCUMENTS

| | | | |
|---|---|---|---|
| 3,739,125 | 6/1973 | Noeske | 200/148 A |
| 3,947,649 | 3/1976 | Hertz | 200/147 R |
| 4,032,736 | 6/1977 | Ruffieux et al. | 200/147 R |
| 4,041,263 | 8/1977 | Noeske | 200/148 A |
| 4,048,456 | 9/1977 | Noeske | 200/148 A |
| 4,052,576 | 10/1977 | Smith | 200/147 R |
| 4,052,577 | 10/1977 | Votta | 200/148 A |
| 4,079,219 | 3/1978 | Weston | 200/147 R |
| 4,080,521 | 3/1978 | Goedecke et al. | 200/148 R |

OTHER PUBLICATIONS

"Electromagnetic Extinction of Arc in $SF_6$," Elektrichestvo, by Poltev, A. I., et al., No. 3, pp. 59–63, 1967.

"Rotating Arc Driver by Magnetic Flux in $SF_6$ Gas," by Fujiwari, K., et al., Yaskawa Electric Mfg. Co. Ltd., Kitayusha, Japan, Second International Symposium on Switch Arc Phenomena, 9–1973.

"The $SF_6$ Circuit-Breaker Breakthrough in Medium Voltage Confirmed," by Hennebert J., Merlin Gerlin, France, Cired Paper #T44, 1975.

"Self-Blasting, A New Switching Principle for Economical $SF_6$ Circuit Breakers," by Jakob, T., et al., Brown Boveri & Co., Ltd., Baden, Switzerland, 1–1978.

*Primary Examiner*—Robert S. Macon

*Attorney, Agent, or Firm*—Marvin Snyder; James C. Davis, Jr.

[57] ABSTRACT

A circuit breaker having a pair of main contacts for carrying electrical current flow during closed contact operation is provided with a pair of concentric auxiliary electrodes and magnetic means for rotating an arc produced by the arc current at the opening of the electrodes and puffer means for supplying a compressed flow of arc extinguishing gas between the auxiliary electrodes when the circuit breaker is opened. In one example, each auxiliary electrode has a magnetic means located therewithin to produce a self-induced magnetic field which drives the arc around the circumference of the auxiliary electrode. In an alternative embodiment, one auxiliary electrode included a rapidly expanding nozzle, and the other auxiliary electrode is shaped as a solid cylindrical pin located concentric with said nozzle. In the preferred embodiment, the insulating gas comprises sulfur hexafluoride.

18 Claims, 4 Drawing Figures

GAS BLAST CIRCUIT BREAKER COMBINING A MAGNETICALLY DRIVEN ROTATING ARC AND A PUFFER INDUCED GAS BLAST

This application is a continuation of application Ser. No. 051,115, filed 6/22/79, now abandoned.

BACKGROUND OF THE INVENTION

This invention relates to a gas blast electric circuit breaker and, more particularly, to a circuit breaker of this type which includes main contacts and auxiliary electrodes and incorporates a puffer structure to compress a volume of insulating gas to be blown over the main contacts and auxiliary electrodes and magnetic means for producing self-induced rotation of an arc produced by separation of the contacts around the periphery of the auxiliary electrodes.

In a gas blast circuit breaker using sulfur hexafluoride ($SF_6$) as the insulating gas, the gas is compressed during breaker opening to provide the gas pressure required for interruption of a high power circuit. This compression requires a relatively massive, high power operating mechanism. Attempts have been made in the prior art to improve the interruption capability of gas blast circuit breakers by driving the arc produced at contact separation in a ring around an auxiliary electrode by a self-induced magnetic field, produced by the arc current flowing through magnetic members located in a ring electrode. This effort has been founded upon the concept that in a plain-break, the arc can reignite in its earlier stationarily heated gas, which has a lower resistance than cold gas. By driving the arc around a ring electrode, the arc is continuously driven into cold gas, while the gas in the path already traveled by the arc can cool off so that at the time when the recovery voltage rises, the arc has to reignite in cooler gas than for a plain-break circuit breaker. A problem for this system is that as the current being interrupted increases, the arc speed around the ring electrode increases, so that for high current the arc moves so fast that it runs into still hot gas produced by the arc in its previous passage around the ring electrode. This fact has been responsible for low voltage ratings at high currents in this type of circuit breaker (e.g., 7.2 kilovolts at 31,000 $amps_{RMS}$ and 3.6 KV at 40 K $amps_{RMS}$).

A prior art example of such a circuit breaker is U.S. Pat. No. 4,032,736, issued June 28, 1977 to Ruffieux et al. Ruffieux et al. describes a fixed chamber breaker in which a pair of arcs 12, 13 is created, one of which is rotated about an annular intermediate electrode 9, and the other arc remains stationary between a centrally-located conductive pin 10 and the interior of contact nozzle pipe 2*a*, 2*b*. The rotating arc 12 heats the insulating gas rising its pressure to an adequate level to extinguish the stationary arc.

A magnetic arc rotating means is disclosed in U.S. Pat. No. 4,079,219, issued Mar. 14, 1978 to Weston. Weston describes a system in which a static volume of $SF_6$ occupies the circuit interrupter, and an arc drawn by opening of the main contacts is transferred to concentric rings 51 and 57, and due to a magnetic field produced by current flowing through windings 50 and 76, respectively, the arc is caused to rotate about the circumference of the rings 51 and 77 through the relatively static gas. Weston describes use of a puffer type arrangement to produce a "relatively small gas blast action which permits the interruption of relatively low currents which might not otherwise be moving rapidly enough within the dielectric gas to be effectively interrupted." (See column 10, lines 9–13). This low current, low voltage puffer in Weston is directed to moving an arc lacking the necessary current to create a magnetic field of adequate strength to rotate the arc, so that the small puffer volume within tube 80 and the restricted flow through slots 100 is sufficient to produce a "small gas blast action".

Another prior art arc interrupter is disclosed by Votta in U.S. Pat. No. 4,052,577, issued Oct. 4, 1977. As shown in FIG. 11, a fixed contact finger cluster 408 and a movable contact 401 carry the operating current. At the opening of the contacts, a coaxial winding 412 connected to movable contact 401 causes rotation of an arc drawn between arcing ring 411 and the contact tips of finger cluster 408, and insulating gas is provided from volume 405 to produce a flow of gas over the contacts. The system is limited to low voltage ratings at high currents, and uses a blast of insulating gas to start the arc movement through a static gas.

Accordingly, it is an object of the instant invention to provide a puffer breaker, which uses a self-induced field to rotate an arc capable of interrupting high voltage, high current circuits.

It is a further object of the instant invention to provide an apparatus and method for rotating an arc between electrodes in a moving stream of insulating gas.

SUMMARY OF THE INVENTION

A circuit breaker according to the instant invention incorporates a pair of main contacts for carrying normal operating current. Affixed to the support structure for each of said contacts is a ring-shaped auxiliary electrode. The insulating gas apparatus includes a puffer piston and cylinder structure. Upon opening of the main contacts, the current is transferred to the ring-shaped auxiliary electrodes. In one embodiment, the auxiliary electrodes are opened by a delayed action mechanism, and the insulating gas located within the cylinders is compressed by the pistons to provide a compressed insulating gas medium to extinguish the arc drawn by separation of the auxiliary electrodes. In another embodiment, means are provided to open the main contacts and simultaneously blow a blast of arc cooling insulating gas outward through the opening between the arcing contacts to assist in the arc transfer to the auxiliary electrodes.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

MANNER AND PROCESS OF MAKING AND USING THE INVENTION

Figure 1:
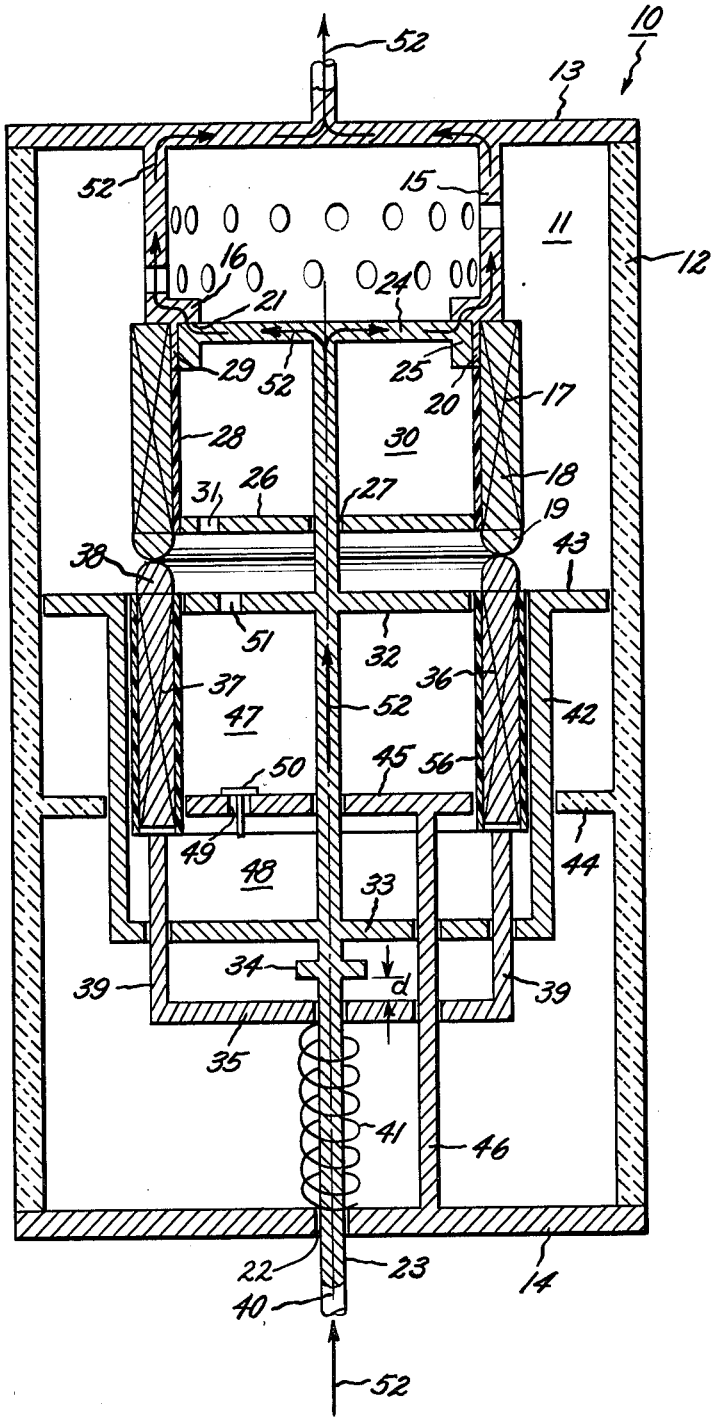
FIG. 1 is a schematic cross-sectional view showing a puffer-type circuit interrupter incorporating the instant invention.
Figure 2:
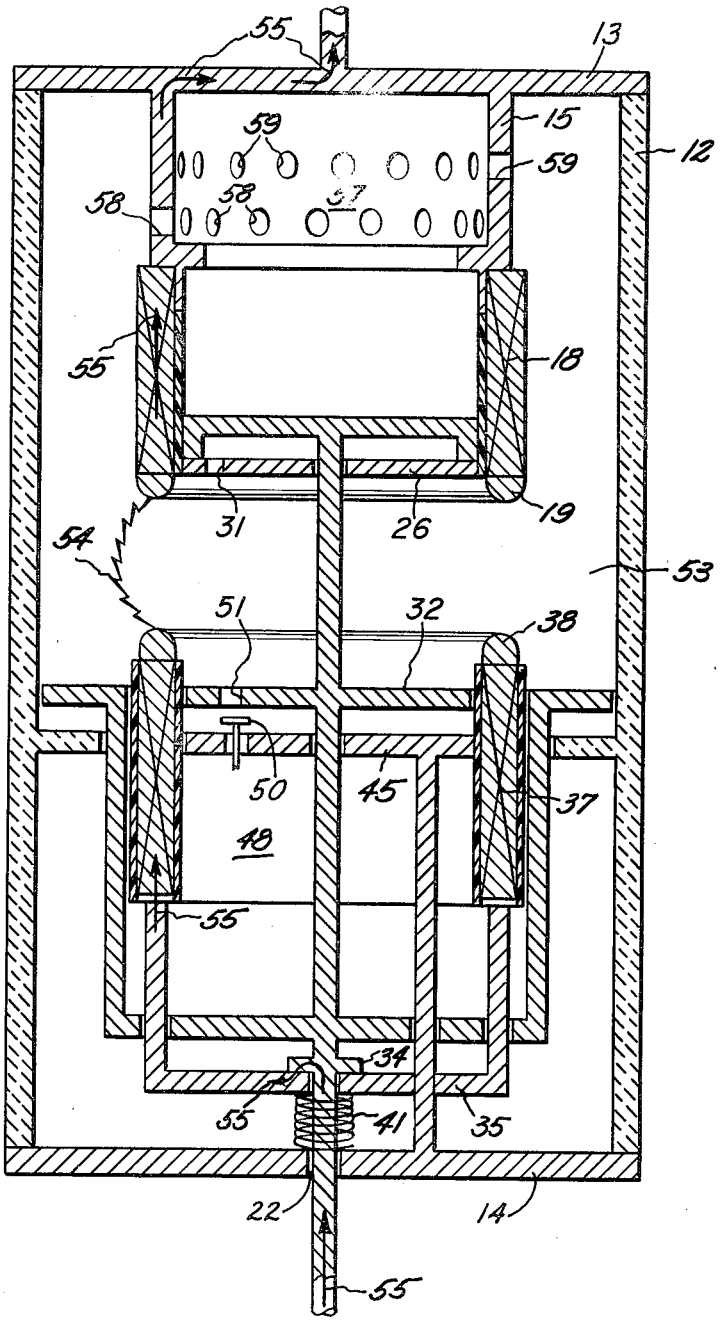
FIG. 2 is a schematic cross-sectional view of the circuit interrupter of FIG. 1 with the contacts and auxiliary electrodes in the open position.

FIGS. 1 and 2 illustrate an embodiment of a circuit breaker 10 of the instant invention, FIG. 1 showing the breaker with contacts closed, and FIG. 2 showing the same breaker with the contacts open. Circuit breaker 10 comprises a volume 11 enclosed by cylindrical wall 12 of insulating material and end walls 13 and 14 attached to the ends of cylindrical wall 12. End wall 13 is made of conductive material and has cylindrical contact support means 15 attached thereto. At one end of ring 15 of conductive material, e.g., aluminum, is attached annular main contact 16 of wear-resistant material, e.g., a copper-tungsten alloy, for carrying normal operating current in the circuit breaker. Also attached to ring 15 is annular auxiliary electrode 17 comprising annular magnetic member 18 and annular auxiliary contact 19. Annular member 20 projects axially from ring 15 and separates the contact surface 21 of contact 16 from auxiliary electrode 17.

End wall 14 has an opening 22 located generally at the center thereof, through which passes electrically conductive actuating rod 23 to which circular disk 24 having main contact 25 thereon is attached. Disk 24 is a conductive material, such as copper or aluminum, and main contact 24 is made of a wear-resistant alloy, such as steel or a coppertungsten alloy. Rod 23 passes through circular plate 26 attached to auxiliary electrode 17 adjacent contact 19 at opening 27. A ring 28 of insulating material, such as alumina, is deposited on the interior surface of auxiliary electrode 17 to provide a smooth mating surface for the outer surface 29 of disk 24. Disk 24, plate 26 and auxiliary electrode 17 define a volume 30 in which insulating gas, usually sulfur hexafluoride, $SF_6$, is stored during normal current operation of the breaker. A plurality of circumferentially spaced openings 31 provide escape passages for the gas during breaker opening, as described below.

Attached to rod 23 are circular walls 32 and 33 which move axially with rod 23. An electrically conductive circular abuttment 34 is attached to rod 23 at a position, such that rod 23 and abuttment 34 move axially a predetermined distance, d, before abutting wall 35 to which annular auxiliary electrode 36 comprising annular magnetic member 37 and annular auxiliary contact 38 are attached via a plurality of rods 39 extending generally parallel to the longitudinal axis 40 of actuating rod 23. Travel of rod 23 through the predetermined distance d between the bottom surface of abuttment 34 and the top surface of wall 35 provides a predetermined time delay between the time separation of main contacts 16 and 25 occurs and the time separation of auxiliary electrodes 19 and 38 occurs. Auxiliary electrodes 19 and 38 are retained closed during travel of abuttment 34 and actuating rod 23 the distance d by spring 41. Thereby, current transfer to the auxiliary electrodes is completed prior to opening of the auxiliary electrodes.

Attached to plate 33 is annular wall 42 surrounding and closely adjacent auxiliary electrode 36. An annular member 43 attached to wall 42, so that its major surfaces are generally perpendicular to wall 42, provides a guide member for wall 42 and electrode 36 as they are moved axia-ly. A guide ring 44 attached to wall 12 assists in guiding and assuring alignment of the movable electrode 38 with fixed electrode 19 during movement thereof. Adjacent guide ring 44 is fixed wall 45 attached by a plurality of circumferentially spaced rods 46 to end wall 14.

Circular wall 32, fixed wall 45 and electrically insulating layer 56 surrounding auxiliary electrode 36 form chamber 47, and fixed wall 45, circular wall 33 and wall 42 define chamber 48. Chamber 48 is in flow communication with chamber 47 via a plurality of circumferentially spaced openings 49 in plate 45 closed by valves 50. Chamber 47 is in flow communication with the area of interface between electrodes 19, 38 via a plurality of circumferentially spaced openings 51 in wall 32.

When the main contacts 16 and 25 and auxiliary electrodes 17 and 36 are in the closed position as shown in FIG. 1, current flows along paths shown by arrows 52, the volume 11 within the breaker is filled with insulating gas at a pressure of from about 1 to about 4 atmospheres and preferably about 4 atmospheres. When the main contacts 16 and 25 are opened by axial movement of actuating rod 23 by operating mechanism (not shown) the breaker current is transferred to the magnetic members 18 and 37 and contacts 19 and 38, respectively, of auxiliary electrodes 17 and 36, held closed during the initial movement of actuating rod 23 by bias spring 41. As movement of rod 23 progresses, the volume 30 is reduced by movement of wall 24 axially toward fixed wall 26, and volume of chamber 47 is reduced by movement of wall 32 toward wall 45. Thereby, the insulating gas initially located within volumes 30 and 47 is compressed and caused to flow in a blast through openings 31 and 51, respectively, to provide a flow of insulating gas radially-outward through the gap 53 between auxiliary contacts 19 and 38 created by movement of actuating rod 23 beyond the distance d necessary to cause abuttment 34 to contact wall 35. The expanding volume of chamber 57 by the movement of disk 24 creates an escape volume for heated insulating gas from the arc area through a plurality of circumferentially spaced openings 58, 59 in ring 15.

As contacts 19 and 38 open, an arc 54 is formed between them by the current flowing through the breaker along paths designated by arrows 55 in FIG. 2. Flow of current is transferred from rod 23 to wall 35 by contact of conductive abuttment 34 with conductive wall 35, and thereby through conductive rods 39, magnetic member 36, contact 38, contact 19 and magnetic member 18. Passage of the electric current through magnetic members 18 and 37 creates a magnetic field with which arc 53 interacts to cause a rotation of the arc about the axis 40 of the breaker. The speed of rotation of the arc is determined by the magnitude of the magnetic field, which is dependent upon the magnitude of current flowing through magnetic members 18 and 36. With a very high current flow, the arc rotates very rapidly about the surface of auxiliary electrodes 17 and 36. The compressed gas flow provided by the pistons 24 and 32 reducing volumes 30 and 47 to maintain a continuous blast of cold insulating gas through which the arc must pass in rotating about the auxiliary electrodes 17 and 36. When current approaches zero in its normal cycle, the magnitude of current is inadequate to maintain ionization of the cold insulating gas, which is necessary to maintain the arc between electrodes 17 and 36. Therefore, the arc is extinguished. Due to the provision of cold insulating gas between contacts 19 and 38, as the voltage across the contacts rises rapidly after current zero, reignition of the arc is inhibited by the high insulating characteristic of the cold insulating gas.

When the breaker recloses, disk 24 moves toward end wall 13 forcing some of the insulating gas in volume 57 radially out through passages 58, 59, through annular gap 53 and into chambers 30 and 47 via openings 31 and 51, respectively. Simultaneously, the volume of chamber 48, which was expanded during breaker opening, is reduced compressing gas in chamber 48 causing valve 50 to be opened and the insulating gas pressure within volume 11 of breaker 12 to be equalized. Thereby, chambers 30 and 47 are recharged with insulating gas for the next circuit breaker opening.

Figure 3:
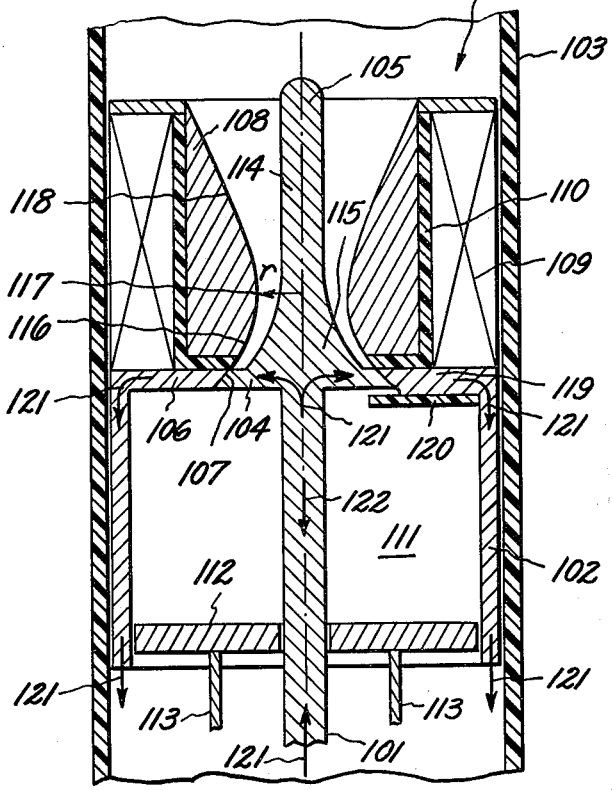
FIG. 3 is a schematic cross-sectional view illustrating an alternate embodiment of the instant invention.
Figure 4:
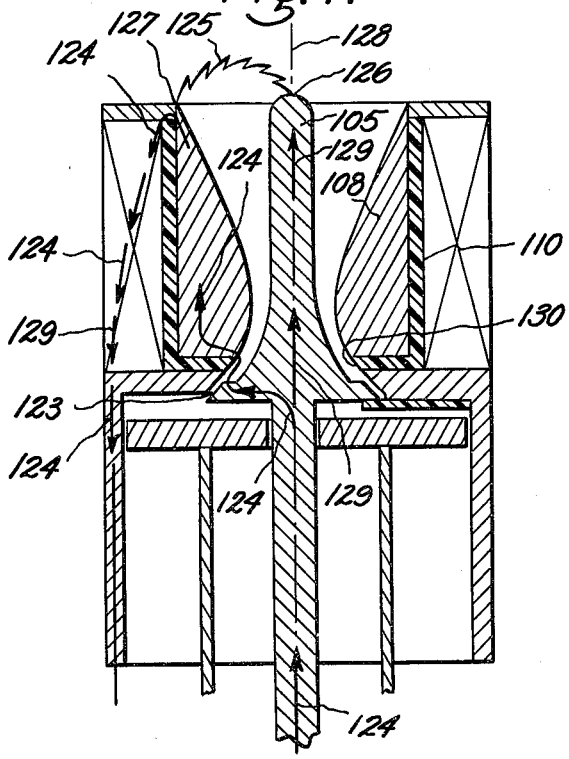
FIG. 4 is a schematic cross-sectional view illustrating the embodiments of FIG. 3 with the contacts open.

In FIGS. 3 and 4 is shown an alternative embodiment of the instant invention, in which coaxial main contacts are attached from one end of a gas blast circuit breaker. As shown in FIG. 3, a breaker 100 comprises a movable contact rod 101 and a fixed cylindrical contact support member 102 within insulating housing 103. Attached to contact rod 101 is an annular main contact 104 and an auxiliary arcing electrode 105, each being coaxial with rod 101. Attached to fixed annular wall 102 is main contact 106 having annular contact area 107, auxiliary arcing electrode 108 and annular magnetic coil 109 separated from said electrode 108 by annular insulating layer 110. Inside cylindrical wall 102 is a chamber 111 bounded by main contacts 104, 106 at one end and annular piston 112 at the opposite end. Attached to piston 112 is a plurality of generally axially aligned circumferentially spaced actuating rods 113 for moving piston 112 relative to contacts 104, 106. Auxiliary arcing contact 105 comprises a generally-cylindrical end member 114 and a curved portion 115 adjacent main contact 104. Auxiliary arcing contact 108 comprises a generally conical portion 116 which curves inward toward throat 117 having the minimum radius, r, and generally conical portion 118 of gradually increasing radius. The above-described shapes of electrodes 105 and 108 provide a nozzle shape having a decreasing cross section in the area adjacent portions 115 and 116 to a minimum radius, r, at throat 117 and a portion of gradually increasing cross section adjacent portions 114 and 118, respectively, of electrodes 105 and 108. Attached to annular contact 106 is a plurality of circumferentially spaced, axially protruding shoulders 119 to which is attached, respectively, a plurality of abuttment members 120 of insulating material.

When the circuit protected by breaker 100 is operating in the normal current range, electrical current flows in the path illustrated by arrows 121 in FIG. 3. When a fault is detected in the line protected by the breaker 100 by current level detection means (not shown) or other control means, mechanical actuating means (not shown) moves contact rod 101 axially downward as viewed in FIGS. 3 and 4 in the direction shown by arrow 122 until contact 104 engages abuttments 120. Simultaneously, the actuating means moves actuating rods 113 in a longitudinal direction opposite that of arrow 122 to compress insulating gas located within the volume 111 and force a high velocity blast of said insulating gas through the opening 123, FIG. 4, between main contacts 104 and 106. An arc 125 is formed between contacts 104, 106 by the current flowing through contact rod 101 and cylindrical wall 102. The path of current flow is altered, so that current flowing in rod 101 crosses gap 123 in an arc travels along a path shown by arrows 124, FIG. 4, through electrode 108 and magnetic member 109 to wall 102. The arc between the contacts 104, 106 produced a self-induced electromagnetic force tending to cause the loop of current in the arc to enlarge. This force along with the blast of insulating gas through gap 123 causes the arc 125 to skip past edge 130, insulating layer 110 and tends to blow the arc 125 to the outermost points 126, 127 of electrodes 105, 108, respectively. The current then follows the path designated by arrows 129. This transfer of the arc causes the current to flow through coil 109, thereby creating a magnetic field around the axis 128 of the arcing electrodes 105, 108. The interaction of arc 125 with the magnetic field tends to drive the arc in rotation about the longitudinal axis 128 of electrode 105. The rotation of arc 125 and the constant supply of cold insulating gas causes arc 125 to be driven continuously through cold insulating gas, so that at current zero inadequate energy remains in the arc to ionize the gas, so that the arc is extinguished, and the circuit is broken.

BEST MODE

The best mode contemplated for practicing my invention incorporates a nozzle structure as shown in FIGS. 3 and 4. The preferred insulating gas is $SF_6$, sulfur hexafluoride.

With my invention high currents in the 30 $kamp_{RMS}$ TO 40 k $AMP_{RMS}$ range may be successfully interrupted at voltages in the 40 kV to 50 kV range. Thereby, the operating rating of circuit breakers of the rotating arc type can be substantially above the 3.6 kV to 7.2 kV range of the prior art.

The foregoing describes a gas blast circuit breaker which combines arc rotation and a continuous blast of insulating gas flowing over the arc to extinguish an arc in a high current, high voltage circuit breaker. By using the abovedescribed combination, the advantages of arc rotation and fluid blast circuit breakers may both be obtained.

I claim:

1. A circuit breaker comprising:

a sealed housing filled with an insulating gas at a predetermined pressure;

first main contact means disposed within said housing;

second main contact means disposed within said housing; said second contact means being movable relative to said first contact means between a first position in which said contact means are in abutment and a second position in which said contact means are separated, and said second contact means being cooperable with said first contact means to carry electrical current when said first and second contact means are in said first position and to interrupt an electrical circuit when said first and second contact means are in said second position;

a first annular auxiliary electrode having an annular arcing surface disposed adjacent said first main contact means;

a second annular auxiliary electrode having an annular arcing surface disposed adjacent said first auxiliary electrode such that said arcing surface of said second auxiliary electrode is adjacent and in axial alignment with said arcing surface of said first auxiliary electrode; said second auxiliary electrode being movable relative to said first auxiliary electrode between a first position in which said first and second arcing surfaces are in abutment and a second position in which said arcing surfaces are separated from each other;

first annular magnetic means disposed in axial alignment with said first auxiliary electrode;

second annular magnetic means disposed in axial alignment with said second auxiliary electrode;

first relatively movable piston and cylinder means disposed within said housing adjacent said first main contact means;

second relatively movable piston and cylinder means disposed within said housing adjacent said second main contact means; and actuating means including means for moving said second main contact means from said first position to said second position, means for moving said second auxiliary electrode from said first position said second position, means for moving said piston relative to said cylinder of said first piston and cylinder means and means for moving said piston relative to said cylinder of said second piston and cylinder means.

2. The apparatus of claim 1 wherein said insulating gas is sulfur hexafluoride and said predetermined pressure is in the range of from about 1 to about 4 atmospheres.

3. The apparatus of claim 2 further comprising an annular conductive support means supporting at one axial end thereof said first main contact means and said first magnetic means, said support means being in electrical contact with said first main contact means and said first magnetic means, and said first auxiliary electrode is attached in electrical contact and in axial abutment with said first magnetic means; and said actuating means includes an electrically conductive rod supporting said second main contact in axial alignment with said first main contact and said actuating means further includes annular support means for said second magnetic means attached to said rod and including annular conductive wall means having said second magnetic means attached in electrical contact to one end of said wall means, and said second auxiliary electrode is attached in electrical contact and in axial abutment with said second magnetic means at the axial end of said second magnetic means opposite the end attached to said wall.

4. The apparatus of claim 3 wherein said first magnetic means includes a layer of electrical insulation disposed on the radially-inner surface thereof and said first magnetic means comprises said cylinder of said first piston and cylinder means and said second main contact comprises a disk electrode mounted on said electrically conductive rod which comprises said piston of said first piston and cylinder means; said second magnetic means includes a layer of electrical insulation disposed on the radially-inner surface thereof and a layer of electrical insulation disposed on the radially-outer surface thereof and said second magnetic means comprises said cylinder of said second piston and cylinder means and said piston of said second piston and cylinder means comprises a circular disk affixed to said electrically conductive rod.

5. The apparatus of claim 4 further comprising abutment means affixed to said conductive rod and said annular conductive wall means has a conductive disk affixed thereto at the axial end of said wall means opposite said second magnetic means, said disk having a circular opening therein through which said conductive rod passes, said abutment means disposed on said rod at a predetermined position, such that when said first and second main contacts and said first and second auxiliary electrodes are in said first position said abutment means is separated from said conductive disk by a predetermined distance.

6. The apparatus of claim 5 further comprising a third cylinder and piston means in flow communication with said second piston and cylinder means; said third cylinder comprising said conductive wall and said second magnetic means and said third piston comprising a disk disposed within said second magnetic means and being rigidly attached to said housing by a plurality of generally axially-extending rods.

7. The apparatus of claim 6 wherein said pressure is approximately 4 atmospheres.

8. A circuit breaker comprising:

a sealed housing filled with an insulating gas at a predetermined pressure;

first main contact means mounted coaxially upon a hollow cylindrical electrically-conductive support means within said housing;

second main contact means adapted to engage said first main contact means, said second main contact means being mounted coaxially upon a contact support rod disposed coaxially within said cylindrical support means and movable thereto in an axial direction to move said second main contact means between a first position in which said first main contact means and said second main contact means are in electrical current-carrying contact and a second position in which said first main contact means and said second main contact means are separated;

cylindrical magnetic coil means attached concentrically at one axial end of said cylindrical support means within said housing and having an auxiliary hollow cylindrical arcing electrode means disposed concentrically within said coil means;

solid rod-type auxiliary arcing electrode means attached to said second main contact means and disposed coaxially within said hollow electrode means;

piston means disposed within said hollow cylindrical support means; and drive means attached to said piston means and operable to move said piston means relative to said hollow cylindrical support means to compress said insulating gas within said cylindrical support means and force a blast of said gas between said first and second main contact means and thence between said arcing electrodes when said second main contact means are moved from said first position to said second position.

9. The apparatus of claim 8 wherein said insulating gas comprises sulfur hexafluoride and said predetermined pressure is in the range of from about 1 to about 4 atmospheres.

10. The apparatus of claim 9 wherein said hollow cylindrical arcing electrode means comprises;

a first generally conical section axially adjacent said first contact means having a larger diameter at the portion of said conical portion adjacent said first contact means and a smaller diameter at a portion spaced from said first contact means;

a throat section at said smaller diameter portion of said first conical portion; and a second generally conical section having its narrower diameter end at said throat section and expanding to its maximum diameter at its distal end.

11. The apparatus of claim 10 wherein said rod type auxiliary arcing electrode means comprises a generally conical portion adjacent said second main contact means and a cylindrical portion extending from said conical portion to a point approximately adjacent the distal end of said second conical section of said arcing electrode.

12. The apparatus of claim 11 wherein said predetermined pressure is about 4 atmospheres.

13. A method of interrupting a high voltage, high current circuit comprising the steps of:

opening a pair of relatively movable main current carrying contacts;

transferring the current carried by said contacts to first and second auxiliary arcing electrodes while said auxiliary arcing electrodes are in abutment;

separating said auxiliary arcing electrodes to form an arc therebetween;

magnetically rotating said arc in a generally circular path about said auxiliary arcing electrodes;

forcing a blast of insulating gas generally crosswise against said rotating arc; and providing, simultaneously with said forcing step, an area of low pressure to which said forced blast of insulating gas is caused to flow.

14. The method of claim 13 wherein said step of forcing a blast of insulating gas over said arc comprises forcing a blast of sulfur hexafluoride gas over said arc.

15. The method of claim 14 wherein said step of forcing a blast of insulating gas over said arc comprises compressing a volume of insulating gas disposed within said circuit breaker by first and second piston and cylinder means to provide a continuous pressurized flow of said insulating gas between said arcing electrodes when they are separated.

16. A method of interrupting a high voltage, high current circuit comprising the steps of:

separating a pair of relatively movable main current-carrying contacts;

transferring an arc formed between said main contacts by said separating step to first and second auxiliary arcing electrodes said auxiliary electrodes being shaped so as to exhibit varied spacing between said auxiliary electrodes;

forcing a blast of pressurized insulating gas between said main contacts and said auxiliary arcing electrodes and generally cross-wise to said arc to cool said arc and to drive said arc toward a region of greater auxiliary electrode spacing; and simultaneously with said forcing step, magnetically rotating said arc in a generally circular path about said auxiliary arcing electrodes.

17. The method of claim 16 wherein said step of forcing a blast of insulating gas over said arc comprises the step of compressing a volume of insulating gas adjacent said main contacts and passing a continuous flow of said insulating gas between said main contacts to provide a continuous blast of insulating gas over said arc.

18. The method of claim 17 wherein said step of forcing a blast of insulating gas over said arc comprises forcing a blast of sulfur hexafluoride over said arc.

* * * * *